US005666692A

United States Patent [19]

Toledo

[11] Patent Number: 5,666,692

[45] Date of Patent: Sep. 16, 1997

[54] ADJUSTABLE POWER CLOSURE

[75] Inventor: George F. Toledo, Fallbrook, Calif.

[73] Assignee: Jackson Corporation, Los Angeles, Calif.

[21] Appl. No.: 594,231

[22] Filed: Jan. 31, 1996

[51] Int. Cl.[6] ..... E05F 1/08

[52] U.S. Cl. ..... 16/80; 16/51; 16/53; 16/65; 16/71

[58] Field of Search ..... 16/80, 71, 51, 16/52, 53, 56, 58, 65, 66, DIG. 10

[56] References Cited

U.S. PATENT DOCUMENTS

| | | | |
|---|---|---|---|
| 2,700,175 | 1/1955 | Carlson . | |
| 2,962,749 | 12/1960 | Sasse | 16/51 |
| 3,124,848 | 3/1964 | Wheeler et al. . | |
| 3,127,160 | 3/1964 | Wallmann . | |
| 3,137,888 | 6/1964 | Blom | 16/51 |
| 3,246,362 | 4/1966 | Jackson | 16/51 |
| 3,724,023 | 4/1973 | Tillmann . | |
| 3,742,553 | 7/1973 | Sittmann | 16/51 |
| 3,947,918 | 4/1976 | Favre . | |
| 4,064,589 | 12/1977 | Bejarano et al. | 16/53 |
| 4,763,384 | 8/1988 | Watabe | 16/65 |
| 4,783,882 | 11/1988 | Frolov . | |
| 4,785,493 | 11/1988 | Tillmann et al. | 16/53 |

FOREIGN PATENT DOCUMENTS

| | | | |
|---|---|---|---|
| 2244759 | 12/1991 | United Kingdom | 16/56 |

*Primary Examiner*—Chuck Y. Mah
*Attorney, Agent, or Firm*—Hill, Steadman & Simpson

[57] ABSTRACT

A door closer having a spindle and cam arrangement for driving a cam plate longitudinally within a housing filled with oil, and dual rods connected to the cam plate at one end and to two pistons respectively at an opposite end. The pistons are reciprocal within cylinders having speed valves in flow communication to opposite sides of the pistons. Dual springs are arranged, one around each rod and compressed between the pistons and a fixed compression plate within the housing. A single adjusting screw extends from a front end of the housing to a threaded central aperture of the compression plate. Rotation of the adjusting screw sets the initial spring compression force of the return springs which influences the rate of closure of the door and the preload force of the door to the door frame.

9 Claims, 1 Drawing Sheet

ADJUSTABLE POWER CLOSURE

BACKGROUND OF THE INVENTION

The present invention relates to an adjustable door closer which provides a spring for storing energy during pivotal opening of a door and releasing the stored energy to close the door thereafter, and a hydraulic resistance to retard the closing of the door in a controlled fashion.

There are currently available several types of door closing mechanisms which both urge the door to a closed position, and slow the closing speed of the door to prevent the door from slamming into the door frame under the force of the closing mechanism, the spring. Door closers are known for swinging doors having spring actuated close with a hydraulic pot to retard the closing. These closers have valving means for passing hydraulic fluid to control the speed of door closing. Such closers are disclosed in U.S. Pat. Nos. 4,064,589 and 3,246,362.

SUMMARY OF THE INVENTION

It is an object of the present invention to provide a door closer having a compact and rugged structure. It is an object of the present invention to provide a door closer having a spring or springs mounted for compression within a closer housing, the spring(s) being easily adjusted for initial spring force or "preload" for opening the door and for setting the range of resistance against opening of the door. It is an object of the present invention to provide an adjuster, easily accessible for changing the spring force of the door closer. It is an object of the invention to provide a hydraulic oil resistance to retard the door closing speed under influence of the spring(s) and an easily accessible valve arrangement for controlling the opening and closing speed of the door.

It is an object of the invention to provide a door closer device which is cost effectively manufactured utilizing a minimum of machining operations.

The objects of the invention are achieved in that a compact housing is provided with a cylinder section and a cam section. Within the cylinder section are two cylinders holding in each a reciprocal piston. The pistons are connected to rods which extend out of the cylinders and into the cam section. A chassis having an upper and lower cam plate spaced apart in parallel orientation by a plurality of cam rollers, is provided within the cam section. The rods are connected to the chassis. A cam is held freely within the chassis between the cam plates for rotation. The cam is fixed to a spindle extending outwardly of the housing. A pair of springs are provided surrounding the rods and compressible between a compression plate held within the cylinder section and the pistons.

The spindle is connected for rotation with respect to the housing with the swinging door. As the spindle rotates, the cam rotates. During door opening, the rotation of the cam causes a pressing against the cam rollers within the chassis and a resultant longitudinal movement of the chassis within the cam section. The pistons are provided with ball check valves. Movement of the chassis moves the pistons longitudinally toward the spindle which allows the hydraulic oil within the cylinder section to pass through the check valves from a back side (spindle side) of the piston to a front side with relatively little hydraulic resistance. Movement of the pistons compresses the springs against the compression plate to generate and store a door restoring force for reclosing the door.

The compression plate is positioned with respect to the housing by an adjusting screw accessible from outside the housing. By rotating the screw, the initial compressed length of the springs can be pre-set. The adjusting screw advantageously extends between the rods, longitudinally of the housing and is accessible via a socket driving tool from a front end of the housing. The adjusting screw is sealed to the housing by an O-ring.

As the door is reclosed under force of the spring and spindle, the pistons are forced forwardly which caused the cam to pivot under force by the chassis, which pivots the door closed. The functioning of pistons and speed valves is generally described in U.S. Pat. No. 3,246,362. To prevent an overly rapid closure of the door the pistons meet with hydraulic resistance to retard the closing. During forward movement the check valves close. The pistons force hydraulic oil through one or two adjustable speed valves which pass the oil into an annular bore which also holds the adjusting screw. The annular bore passes the oil to a back side of the pistons.

DETAILED DESCRIPTION OF THE PREFERRED EMBODIMENTS

Figure 1:
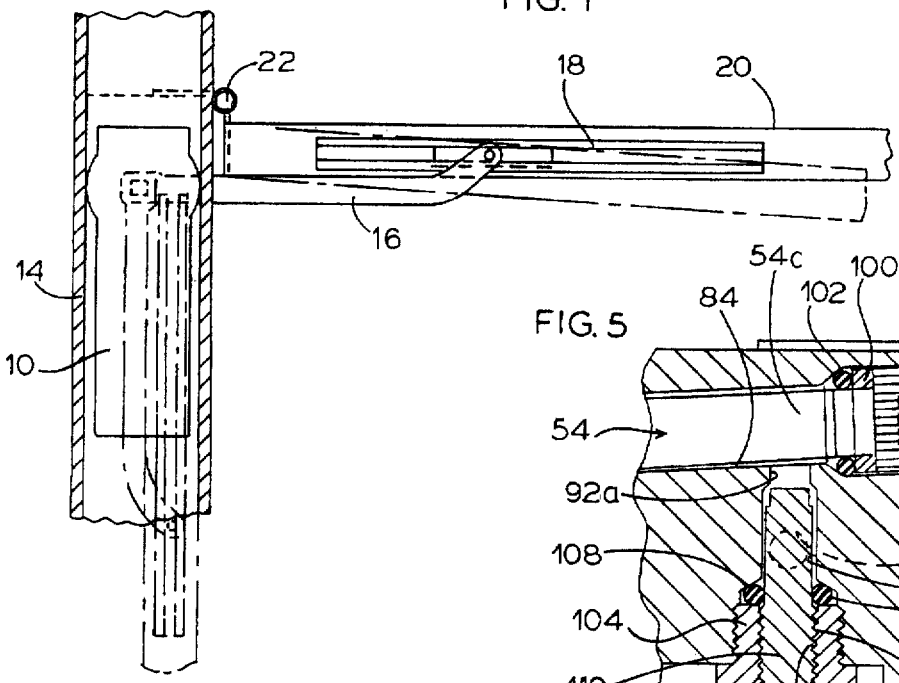
FIG. 1 is a plan view of a door closer connected to a door and a door frame according to the present invention.

FIG. 1 illustrates a door closer 10 mounted to a overhead door style 14 and connected by a closing lever 16 to a slide rail 18 mounted to a door 20. The door 20 pivots about a hinge 22 to a closed position as shown dashed in FIG. 1. Alternately, the door closer 10 can be mounted to the door 20 and an appropriate fashioned lever can connect the door closer to a sliding attachment mounted to the door style 14 (not shown).

Figure 2:
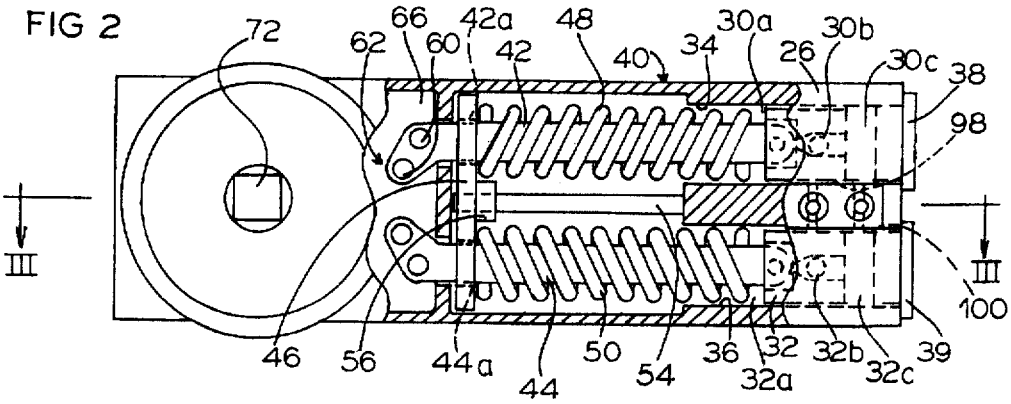
FIG. 2 is a bottom view of the door closer of FIG. 2 with a portion of the cover plate removed for clarity.

FIG. 2 shows the door closer 10 in bottom view. A cover 26 is partially removed to expose the mechanism within the closer. Two pistons 30, 32 are closely confined within cylinders 34, 36 within a housing 40 of the closer 10. The cylinders 34, 36 are closed by caps 38, 39 respectively. The pistons 30, 32 are connected to rods 42, 44 respectively. The rods 42, 44 pass through apertures **42*a*, 44*a* through a compression plate 46 which is movable within the housing 40. A first spring 48 and a second spring 50 are located between the compression plate 46 and the pistons 30, 32** respectively.

An adjusting screw 54 is threaded into the compression plate 46 and/or a boss 56 welded to or otherwise formed to the compression plate 46. Turning of the adjusting screw 54 about its axis will therefore position the compression plate 46 longitudinally within the housing 40.

Using a right handed thread, threading the adjusting screw 54 clockwise into the compression plate 46 and boss 56 will draw the compression plate to the right of FIG. 2, and a counterclockwise rotation will position the compression plate 46 to the left of FIG. 2. As can be understood by moving the compression plate 46 to the right in FIG. 2, the springs 48, 50 are compressed against the pistons 30, 32.

The rods 42, 44 are connected by screws 60 to a cam chassis 62 comprising lower and upper cam plates 64, 66 respectively. Between the cam plates 64, 66 resides a cam 70 which is connected to a spindle 72 extending downwardly through the housing 40 and extending above the upper cam plate 66 to be journaled in a roller bearing 74 held within a raised rim 76 from a wall 78 of the housing 40. The cam 70 is rotatable between the cam plate 64, 66 and abuts rollers (not shown) held between the lower and upper cam plates 64, 66 as described more completely in U.S. Pat. No. 3,246,362.

Upon rotation of the spindle 72 by rotation of a door, the cam 70 forces the chassis 62 to move longitudinally within the housing 40. The position shown in FIGS. 2 and 3 corresponds to a door closed position. Upon rotation of the spindle 72, the chassis 62 moves in a direction A within the housing 40. As demonstrated in FIG. 2, movement in the direction A would drive the pistons 30, 32 within the housing 40 and further compress the springs 48, 50 against the compression plate 46. The compression plate 46 is held stationary within the housing 40 by the adjusting screw 54.

Figure 3:
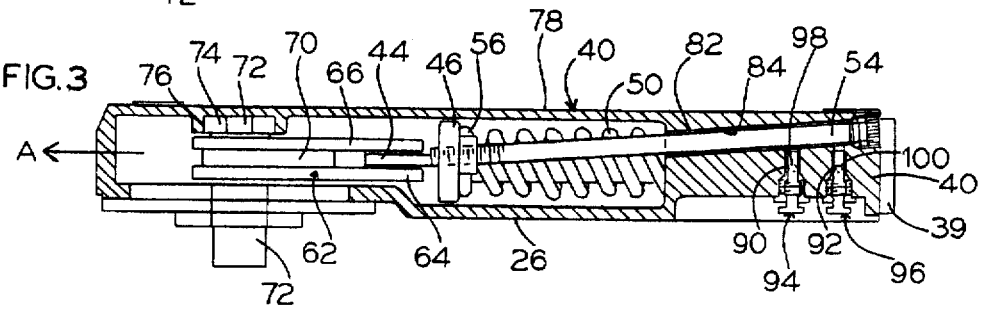
FIG. 3 is a sectional view taken generally along line III—III of FIG. 2.

When the pistons 30, 32 are forced to the left in FIGS. 2 and 3, oil held within the housing 40 is compressed by the movement of the pistons. The oil under pressure is forced from a back side 30*a*, 32*a* of the pistons 30, 32 respectively through open ballcheck valves 30*b*, 32*b* formed through the pistons to a front side 30*c*, 32*c* of the pistons 30, 32 within the cylinders 34, 36.

An annular channel 82 is formed around the adjusting screw 54 and defined by a bore 84 arranged at a slightly declined angle and longitudinally through the housing 40. The bore 84 has an increased opening 86 at a front end of the housing 40.

Figure 5:
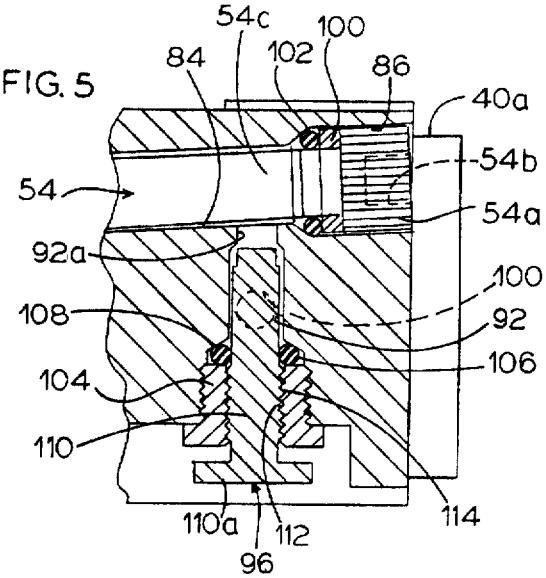
FIG. 5 is an enlarged partial sectional view taken from FIG. 3.
Figure 4:
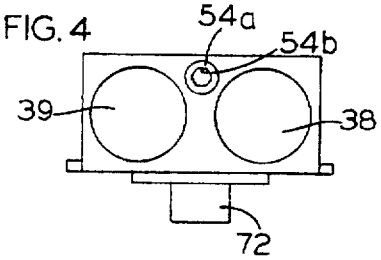
FIG. 4 is a right side view of the door closer of FIG. 3.

As shown in FIGS. 3 and 5, speed valve bores 90, 92 hold therein speed valves 94, 96. Lateral bores 98, 100 communicate from the speed valve bores 90, 92 respectively to both cylinders 34, 36. The speed valve bores 90, 92 also communicate into the annular channel 82.

After the door is open, and the springs 48, 50 are compressed, upon release of the door the springs 48, 50 will release their compressed energy to force the pistons 30, 32 to the right in FIG. 2 and move the rods 42, 44 which holds the chassis 62 to the right in FIG. 2 which exerts a reverse force on the cam to rotate the spindle 72 to close the door. When the pistons are forced to the right in FIG. 2, oil on the front side 30*c*, 32*c* of the pistons in the cylinders 34, 36 is forced through the lateral bores 98, 100, through the speed valve bores 90, 92, past the speed valves 94, 96, and into the channel 82 where the oil passes to the left in FIG. 2 along the channel 82 and into the housing 40 on the back side 30*a*, 32*a* of the pistons. The speed valves can be adjusted accordingly for the speed of door closure as well as the two speed closing range based on the axial positioning of the speed valves with regard to the pistons. A first "closing" range with oil passing through both bores 98 and 100 and a second "latching" range with oil passing only through the front lateral bore 100. The closing range is from a door open position to about a slightly open door; the latching range is from slightly open to closed.

The adjusting screw 54 extends to a front side 40*a* of the housing 40 in the enlarged opening 86. The screw is a socket head type having a head 54*a* which fits recessed into the bore 86 and provides a socket 54*b* for engagement by a hexagonal tool such as an Allen wrench to rotate the screw. The head 54*a* connects to a shaft 54*c* of the screw. A pressure limit washer 100 is provided beneath the head 99 of the adjusting screw 54, and beneath the pressure limit washer 100 is an O-ring seal 102 to seal the casing 40 around the adjusting screw 54 to prevent leakage of oil.

As shown in FIG. 5, the speed valve 96 is constructed using a metering valve nut 104 which compresses an O-ring 106 against a shoulder 108 of the bore 92 and against a metering valve element 110. The nut 104 is tightly screwed into the bore 92. The nut 104 provides an axial threaded bore 112 for receiving an outside thread 114 of the metering valve element 110. The O-ring 108 seals the element 110 to the bore 92 as it is axially adjusted to open or close an outlet 92*a* of the bore 92 leading into the channel 84. The element 110 has a screw head 110*a* for axial adjustment.

The present invention thus provides for a convenience and rugged means of adjusting the spring compression force for creating a closure force for closing a door. A single adjusting screw can thereby adjust the compression of dual springs. The adjusting screw and the bore therefore can be angled to provide a convenient access for adjusting the screw as well as allowing for a smaller end face of the door closer, geometrically. By utilizing the bore 84 for both locating the adjusting screw 54 and for providing the annular channel 82, an economical construction is achieved with reduced manufacturing steps.

Although the present invention has been described with reference to a specific embodiment, those of skill in the art will recognize that changes may be made thereto without departing from the scope and spirit of the invention as set forth in the appended claims.

I claim as my invention:

1. A door closer comprising:

a housing having an enclosed interior for holding hydraulic oil;

a spindle extending from said housing;

a driven means for reciprocating within said housing;

a rotation means connected to said spindle for reciprocating said driven means upon rotation of said spindle;

first and second pistons;

cylinders formed in said housing for holding said first and second pistons;

a first rod and a second rod connected to said first and second pistons respectively and extending out from said cylinders, said first and second rods connected to said driven means;

a compression plate arranged between said pistons and said driven means;

first and second springs surrounding said first and second rods respectively and arranged between said compression plate and said pistons; and an adjusting screw arranged parallel to and between said first and second rods and engaged to said compression plate and having a tool engageable formation accessible from an outside of said housing, rotation of said adjusting screw positioning said compression plate to add compression or relieve compression of said first and second springs.

2. The door closer according to claim 1, further comprising adjustable oil valves arranged in a flow circuit between a front side and a back side of said pistons for adjusting the oil resistance opposing movement of said pistons within said housing.

3. The door closer according to claim 2, wherein said adjusting screw passes through an oversized bore in said housing forming an annular space between said oversized bore and said adjusting screw, said annular space in flow communication with said adjusting valves, forming a pathway of the flow circuit.

4. The door closer according to claim 1, wherein said driven means comprises upper and lower plates arranged in parallel relationship and a roller therebetween, and said rotation means comprises a cam located between said upper and lower plates and adapted to press against at said roller to reciprocate said driven means.

5. The door closer according to claim 1, wherein said compression plate comprises a threaded bore, and said adjusting screw comprises a threaded region engaged to said threaded bore, said compression plate positioned along said threaded region by rotation of said adjusting screw.

6. The door closer according to claim 5, wherein said adjusting screw comprises a tool engaging end and a shaft, and the closer comprises an O-ring surrounding said shaft, said tool engaging end adapted to compress said O-ring to said housing to seal thereto.

7. The door closer according to claim 6, further comprising a pressure limit washer arranged between said O-ring and said tool engaging end around said shaft.

8. In a door closer having a housing and a spindle adapted to rotate upon rotation of a door with respect to a door frame and a reciprocating element within the door closer housing which reciprocates in response to the rotation of the spindle, and a hydraulic piston which reciprocates with the reciprocating element within a cylinder bore of the housing and a spring which compresses against the piston during opening of the door and expands to translate the piston to close the door, the improvement comprising:

a compression plate between said piston and said reciprocating element, and said compression plate pressed to a side of said spring opposite said piston;

an adjusting screw extending into said closer housing from an outside thereof and threadingly engaged to said plate; and a bore formed through said housing for holding said adjusting screw, said bore oversized to provide an annular pathway for oil to flow from opposite sides of said piston.

9. The improvement according to claim 8, wherein said adjusting screw is arranged along side said spring, and said adjusting screw comprises a tool engagable head exposed on an outside of said housing, said adjusting screw sealed around said bore by an O-ring.

* * * * *